US009640922B2

(12) United States Patent
Kanemura

(10) Patent No.: US 9,640,922 B2
(45) Date of Patent: May 2, 2017

(54) CONNECTOR

(71) Applicant: Sumitomo Wiring Systems, Ltd., Yokkaichi, Mie (JP)

(72) Inventor: Keisuke Kanemura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/534,342

(22) Filed: Nov. 6, 2014

(65) Prior Publication Data

US 2015/0140846 A1 May 21, 2015

(30) Foreign Application Priority Data

Nov. 19, 2013 (JP) ..... 2013-238644

(51) Int. Cl.
*H01R 13/703* (2006.01)

(52) U.S. Cl.
CPC ..... *H01R 13/7032* (2013.01)

(58) Field of Classification Search
CPC ..... H01R 13/7032; H01R 13/7031; H01R 13/701
USPC ..... 439/188, 507, 489
See application file for complete search history.

(56) References Cited

U.S. PATENT DOCUMENTS 5,145,356 A * 9/1992 Minnis ..... B60R 21/01 439/188
5,263,872 A * 11/1993 Marpoe, Jr. ..... H01R 13/7032 200/51.1
5,588,855 A * 12/1996 Nankoh ..... H01R 13/701 439/188
5,647,754 A * 7/1997 Kohno ..... H01R 13/7032 200/51.1
5,647,762 A * 7/1997 Fukuda ..... H01R 13/7032 439/188
5,743,760 A * 4/1998 Inaba ..... H01R 13/7031 439/489
5,788,520 A * 8/1998 Roche ..... H01R 13/7032 200/51.1
5,791,922 A * 8/1998 Takata ..... H01R 13/7032 439/188
5,803,756 A * 9/1998 Furutani ..... H01R 13/7032 200/51.1

(Continued)

FOREIGN PATENT DOCUMENTS

JP 2009-230988 10/2009

*Primary Examiner* — Amy Cohen Johnson
*Assistant Examiner* — Matthew T Dzierzynski
(74) *Attorney, Agent, or Firm* — Gerald E. Hespos; Michael J. Porco; Matthew T. Hespos

(57) ABSTRACT

Out of resilient contact pieces (21) provided on a shorting terminal (20), contact portions (24) to come into contact with specific terminal fittings (10) to be shorted by the shorting terminal (20) are provided on a front side of the shorting terminal (20) in a connecting direction to a mating connector (M). A shorting terminal accommodating chamber (46) provided in a housing (40) is open forward in the connecting direction to the mating connector (M). The shorting terminal (20) can be accommodated into the shorting terminal accommodating chamber (46) from front in the connecting direction. Front press-fit portions (34) to be press-fitted to wall portions (48A) of the housing (40) forming the shorting terminal accommodating chamber (46) are provided at positions of the shorting terminal (20) juxtaposed with the contact portions (24) in a width direction.

11 Claims, 16 Drawing Sheets

(56) References Cited

U.S. PATENT DOCUMENTS

| | | | | | |
|---|---|---|---|---|---|
| 5,816,834 | A * | 10/1998 | Nimura | H01R 13/7032 | 200/51.1 |
| 5,944,547 | A * | 8/1999 | Golab | H01R 13/7032 | 200/51.1 |
| 6,171,124 | B1 | 1/2001 | Kojima | | |
| 6,257,922 | B1 * | 7/2001 | Shinozaki | H01R 13/7032 | 439/188 |
| 6,361,377 | B1 * | 3/2002 | Saka | H01R 13/7032 | 439/745 |
| 6,827,596 | B2 * | 12/2004 | Hori | H01R 13/6275 | 439/188 |
| 6,942,510 | B2 * | 9/2005 | Nakamura | H01R 13/7033 | 439/188 |
| 6,953,364 | B2 * | 10/2005 | Nakamura | H01R 13/7031 | 439/352 |
| 7,294,015 | B2 * | 11/2007 | Fujii | H01R 13/641 | 439/489 |
| 7,351,084 | B2 * | 4/2008 | Ohtaka | H01R 13/701 | 439/188 |
| 7,488,197 | B2 * | 2/2009 | Shinozaki | H01R 12/716 | 439/489 |
| 7,955,104 | B1 * | 6/2011 | Wicks | H01R 13/7032 | 439/188 |
| 2004/0229487 | A1 * | 11/2004 | Lutsch | H01R 13/7032 | 439/188 |

* cited by examiner

CONNECTOR

BACKGROUND

1. Field of the Invention

The invention relates to a connector.

2. Description of the Related Art

Japanese Unexamined Patent Publication No. 2009-230988 discloses a connector with a plurality of terminal fittings and a shorting terminal accommodated in a housing. The terminal fittings are shorted by the shorting terminal when the connector is not connected to a mating connector and a shorted state of the terminal fittings is released by a short releasing portion provided in the mating connector when the connector is connected properly to the mating connector.

Resilient contact pieces provided on the shorting terminal generally are held resiliently in contact with the terminal fittings to short the terminal fittings and the short releasing in the mating connector enters between specific terminal fittings and the resilient contact pieces to release the shorted state of the terminal fittings when the connector is connected properly to the mating connector.

Front parts of resilient contact pieces described in Japanese Unexamined Patent Publication No. 2009-230988 are formed into chevron shapes and have tops that function as contact portions to contact the terminal fittings. A shorting terminal is pushed into a shorting terminal accommodating chamber provided before a recess in an intermediate part of a housing and a retainer is to be mounted through the recess.

The connector described must reliably keep the terminal fittings shorted when the connector is not connected to a mating connector. Accordingly, it is considered to increase contact pressures of the resilient contact pieces with the terminal fittings by increasing resilient forces of the resilient contact pieces, thereby enhancing connection reliability. However, the resilient contact pieces of the connector contact a lower wall of a terminal accommodating portion and resiliently deflect. Thus, the contact portions slide in contact with the wall to be set in the terminal accommodating chamber when the shorting terminal is accommodated into the shorting terminal accommodating chamber. The contact portions continue to slide in contact with the wall while the resilient contact pieces are kept resiliently deflected until the shorting terminal reaches a proper position. Thus, the shorting terminal remains subject to large resistance from the start to the end of a shorting terminal accommodating operation if the resilient forces of the resilient contact pieces are increased. Therefore there is a problem of making the shorting terminal accommodating operation difficult.

The invention was completed based on the above situation and aims to provide a connector capable of facilitating a shorting terminal accommodating operation and enhancing connection reliability between a shorting terminal and terminal fittings by shortening a press-fitting distance and suppressing settling of resilient contact pieces.

SUMMARY OF THE INVENTION

The invention is directed to a connector with a housing that includes cavities and a shorting terminal accommodating chamber. Terminal fittings are accommodated in the cavities and a shorting terminal is accommodated in the shorting terminal accommodating chamber. Resilient contact pieces are provided on the shorting terminal and contact specific terminal fittings to short the specific terminal fittings when the connector is not connected to a mating connector.

A short releasing portion is provided in the mating connector and enters between the specific terminal fittings and the resilient contact pieces to release a shorted state of the specific terminal fittings when the connector is connected properly to the mating connector. Contact portions of the resilient contact pieces to be held in contact with the specific terminal fittings are provided on a front side of the shorting terminal in a connecting direction to the mating connector. The shorting terminal accommodating chamber is open forward in the connecting direction and the shorting terminal is capable of being accommodated into the shorting terminal accommodating chamber from the front in the connecting direction. A front press-fit portion is press-fit to a wall of the shorting terminal accommodating chamber and at a position of the shorting terminal juxtaposed with the contact portions in a width direction.

The shorting terminal is fixed to the housing at the position proximate to the contact portions and juxtaposed with the contact portions in the width direction. Thus, the contact portions of the shorting terminal are secure, and a contact pressure of the shorting terminal with the terminal fittings is stable. Further, the front press-fit portion starts to be press-fit to the housing at a final stage of accommodating the shorting terminal into the shorting terminal accommodating chamber. Thus, the accommodating operation is easier than a case where the front press-fit portion is subjected to large resistance from the start to the end of the accommodating operation. Therefore, the shorting terminal can be accommodated easily and connection reliability between the shorting terminal and the terminal fittings is enhanced.

A rear end of the shorting terminal accommodating chamber in the connecting direction may have a rear wall, and a rear end part of the shorting terminal accommodating chamber in the connecting direction may be formed into a bag-like closed portion whose walls on four sides and a rear side are connected. The shorting terminal may include a rear press-fit portion to be press-fit into the closed portion.

The bag-like closed portion with four walls connected on the rear end has a high rigidity and press-fitting the rear press-fit portion into this rigid structure fixes the rear end part of the shorting terminal firmly to the housing and prevents looseness of the shorting terminal. As a result, a contact pressure of the shorting terminal with the terminal fittings is highly stable. Further, the rear press-fit portion starts to be press-fit into the housing at the final stage of accommodating the shorting terminal into the shorting terminal accommodating chamber. If the press-fitting portion extends back from the front surface, the rear press-fitting portion would be subjected to large resistance from the start to the end of the accommodating operation. However, the rear press-fit portion of the invention is press-fit only at the final stage of the accommodating operation and the accommodating operation is performed easily.

An opening may be provided on a partition wall between the shorting terminal accommodating chamber and the cavities in which the specific terminal fittings are to be accommodated. The opening may be open forward in the connecting direction and allows the contact portions to project into the cavities. According to such a configuration, the shorting terminal is accommodated into the shorting terminal accommodating chamber without the resilient contact pieces being resiliently deflected. Thus, no resistance is created by deflecting the resilient contact pieces during the accommodating operation. Further, the shorting terminal is accommodated into the shorting terminal accommodating chamber without the contact portions sliding in contact with the housing. Hence, there is no abrasion of the contact portions due to the sliding contact of the contact portions with the housing and connection reliability between the shorting terminal and the terminal fittings is enhanced.

The front press-fit portion may be a projection having an upright surface on a front end in the connecting direction. The front end of the front press-fit portion is hooked to the housing when the shorting terminal is accommodated in the shorting terminal accommodating chamber. Thus, the shorting terminal cannot come out forward from the shorting terminal accommodating chamber.

The connector of the invention facilitates a shorting terminal accommodating operation and enhances connection reliability between a shorting terminal and terminal fittings.

DETAILED DESCRIPTION

A female connector in accordance with one embodiment of the invention is identified by the letter F in FIGS. 1 to 16 and includes a female housing 40. Female terminal fittings 10 and shorting terminals 20 are disposed in the housing 40. The shorting terminals 20 are configured for shorting specific ones of the female terminal fittings 10 as explained herein.

Figure 1:
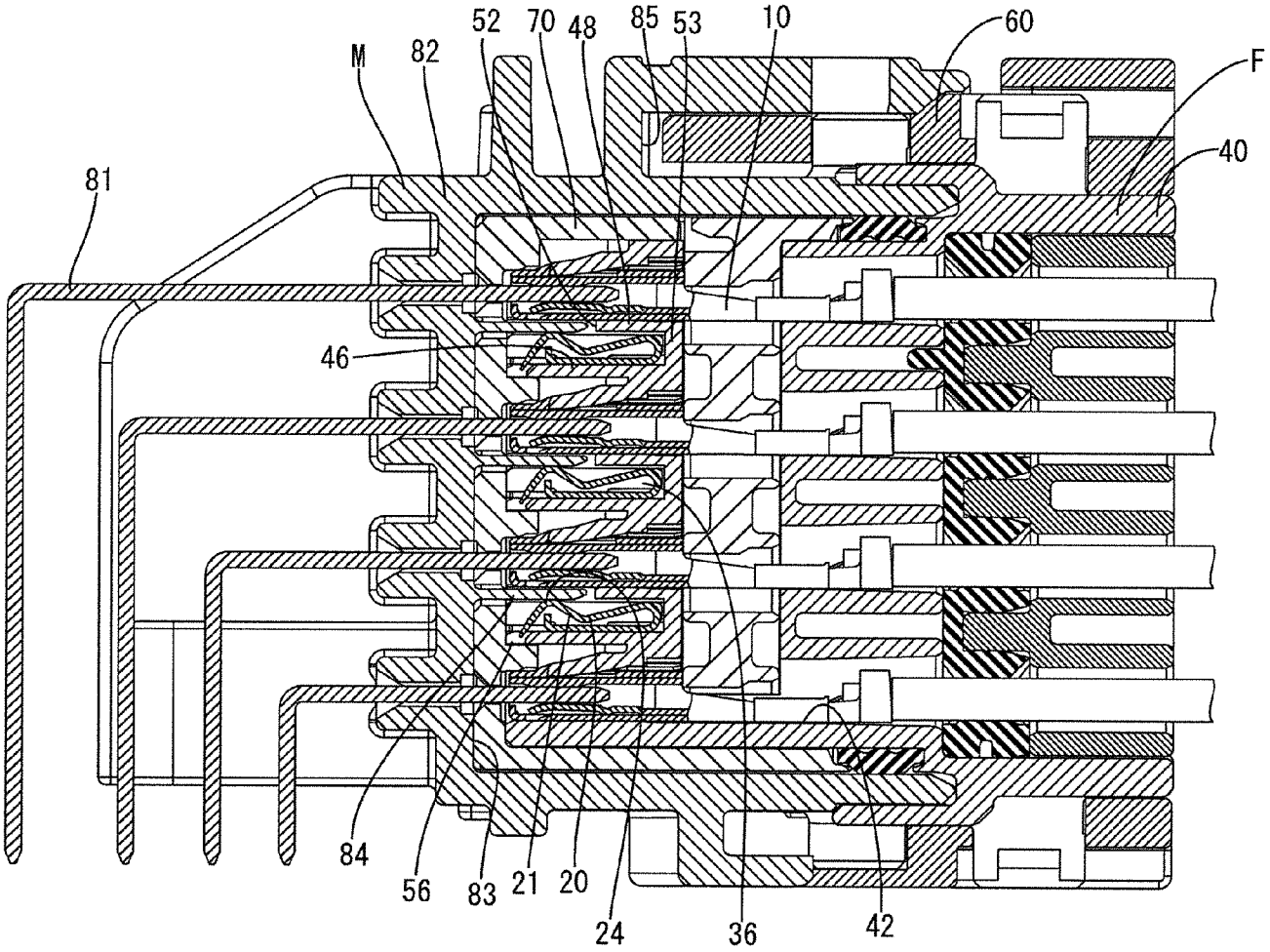
FIG. 1 is a section showing a properly connected state of a female connector and a male connector of an embodiment of the invention.
Figure 2:
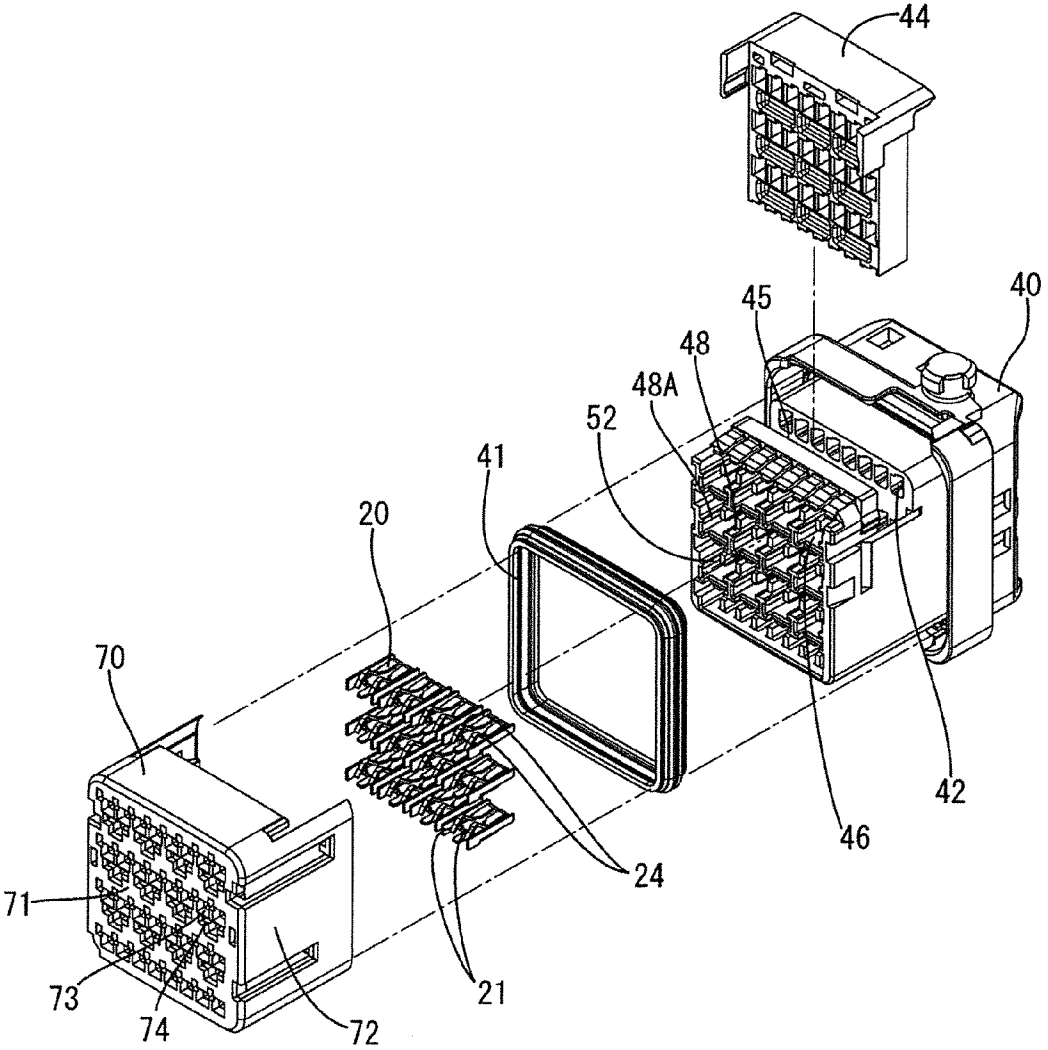
FIG. 2 is an exploded perspective view of the female connector

As shown in FIG. 1, a lever 60 is mounted rotatably on the female connector F and is configured to assist connecting the female connector F to a mating male connector M. In the following description, the end that is connected to a mating connector and the opposite end are referred to as the front and rear respectively and the terms upper and lower refer to the orientation shown in FIG. 1.

The male connector M includes male terminal fittings 81 and a housing 82 for holding the male terminal fittings 81. The male connector M is a board connector and the male terminal fittings 81 extending from the male housing 82 are to be connected to an unillustrated board.

The male housing 82 is made of synthetic resin and includes connector fittings 83 arranged side by side in a lateral direction. The connector fittings 83 are configured for receiving the respective female connectors F.

A short releasing portion 84 projects forward from a back wall of the connector fitting 83 and is configured for entering between the female terminal fittings 10 and the shorting terminal 20 to release a shorted state of the female terminal fittings 10. A lever accommodating portion 85 is provided above each connector fitting 83 for accommodating the lever 60 when the two connectors F, M are connected.

Each male terminal fitting 81 is formed from a square wire made of electrically conductive metal and is bent into an L shape. One end of each male terminal fitting 81 projects forward from the back wall of the connector fitting 83 for electrical connection to the female terminal fitting 10 and the other end extends back from the rear surface of the male housing 82 for connection to the unillustrated board, such as by soldering.

Figure 3:
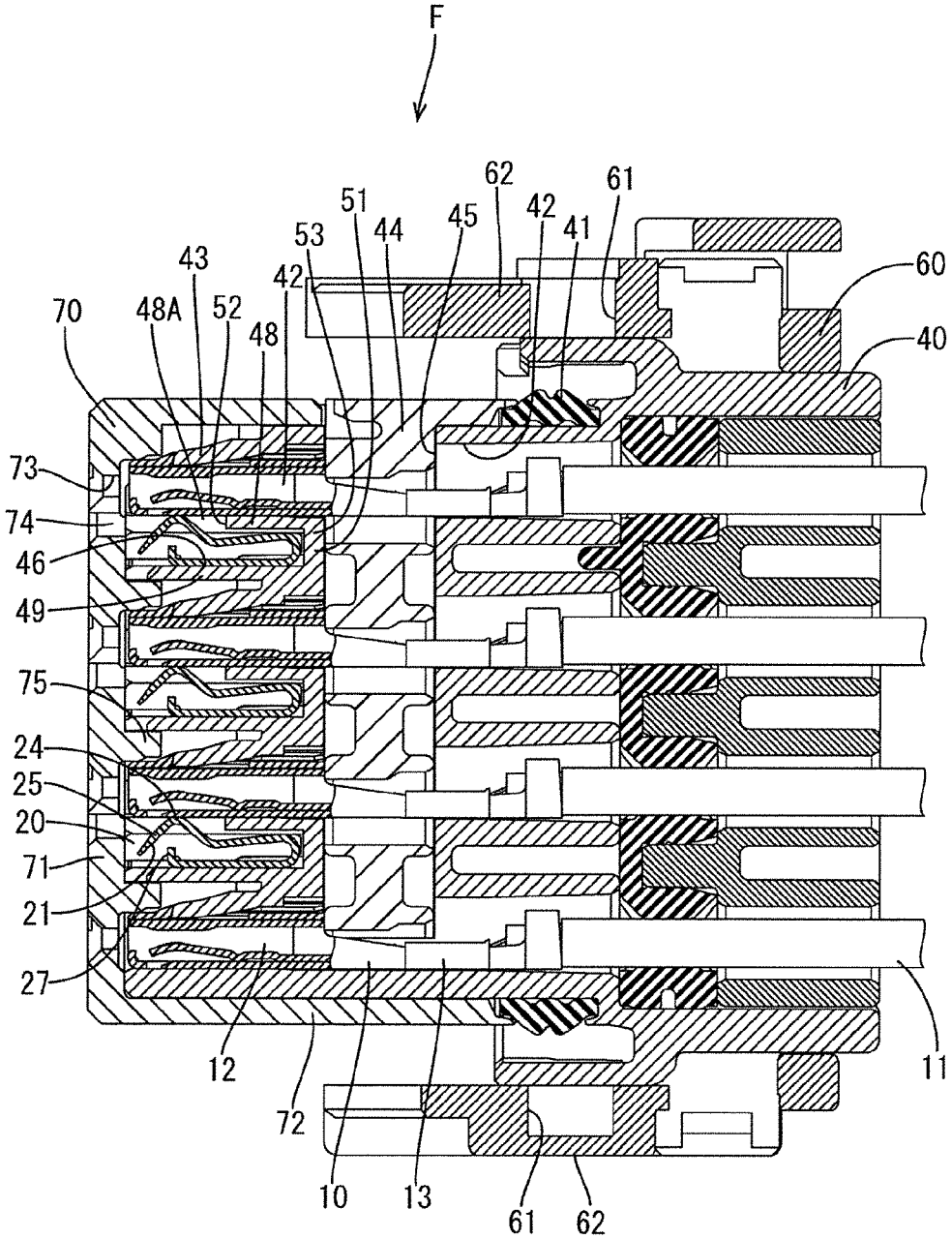
FIG. 3 is a section showing the female connector.

As shown in FIG. 3, the female connector F is formed by assembling the lever 60 with the female housing 40. The female housing 40 is a wide rectangular block made of synthetic resin and is configured for accommodating the female terminal fittings 10 and shorting terminals 20 therein.

The female terminal fitting 10 is formed by press-working an electrically conductive metal plate to be long in a front-back direction and narrow in lateral directions. A front part of the female terminal fitting 10 is a rectangular tubular connecting portion 12 configured to receive the male terminal fitting 81 from the front, and a rear part defines a barrel 13 to be crimped to the end of the wire 11.

The lever 60 is rotatably mounted on the female housing 40 and is for assisting a connecting operation to the male connector M. The lever 60 has two cam plates 62 and an operating portion (not shown) couples the cam plates 62 so that the lever 60 defines a U-shape. Each cam plate 62 has a cam groove 61. The two connectors F, M are connected lightly with the lever 60 is set at an initial position. As a result, the cam pins of the male connector M are introduced to the entrances of the cam grooves 61. The lever 60 then is rotated from the initial position to a connection position. As a result, the cam pins (not shown) move along the cam grooves 61 and the two connectors F, M are pulled toward each other by a cam action based on the engagement of the cam pins and the cam grooves. The two connectors F, M reach a properly connected state when the lever 60 reaches the connection position.

A seal ring 41 having a substantially rectangular shape is fit on the outer peripheral surface of the female housing 40. In the properly connected state of the female connector F and the male connector M, the seal ring 41 is sandwiched between the outer peripheral surface of the female housing 40 and the inner peripheral surface of the connector fitting 83 to hold the interior of the connector fitting 83 in a sealed state.

The female housing 40 includes cavities 42 for accommodating the female terminal fittings 10 crimped to the ends of the wires 11. The cavities 42 are formed in each of four vertically arranged stages. A resin locking lance 43 is cantilevered forward from the upper surface of each cavity 42. The resin locking lance 43 primarily locks and retains the female terminal fitting 10 inserted into the cavity 42.

A retainer inserting portion 45 into which a retainer 44 is to be inserted is provided in a substantially central part of the female housing 40 in the front-back direction. The retainer inserting portion 45 is open on the upper surface of the female housing 40 and communicates with all the cavities 42.

The retainer 44 is formed of a synthetic resin similar to the female housing 40. The retainer 44 is held at a partial locking position for permitting forward movements of the female terminal fittings 10 before the female terminal fittings 10 are inserted. The retainer 44 is pushed to a full locking position after the female terminal fittings 10 are inserted to secondarily lock and retain the female terminal fittings 10.

The female housing 40 includes shorting terminal accommodating chambers 46 for accommodating the shorting terminals 20. The shorting terminal accommodating chambers 46 are located between the cavities 42 in a vertical direction. The shorting terminal 20 accommodated in the shorting terminal accommodating chamber 46 shorts the female terminal fittings 10 inserted into two cavities 42 provided thereabove.

Figure 4:
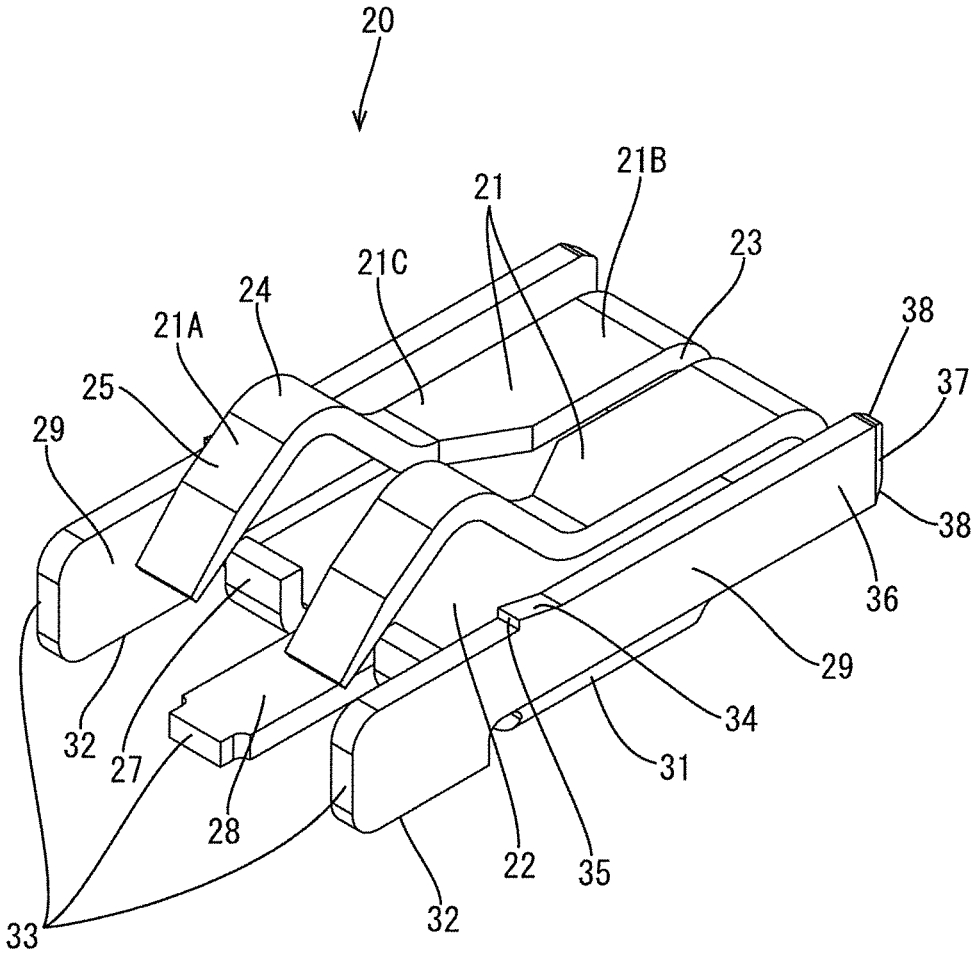
FIG. 4 is a perspective view of the shorting terminal.
Figure 5:
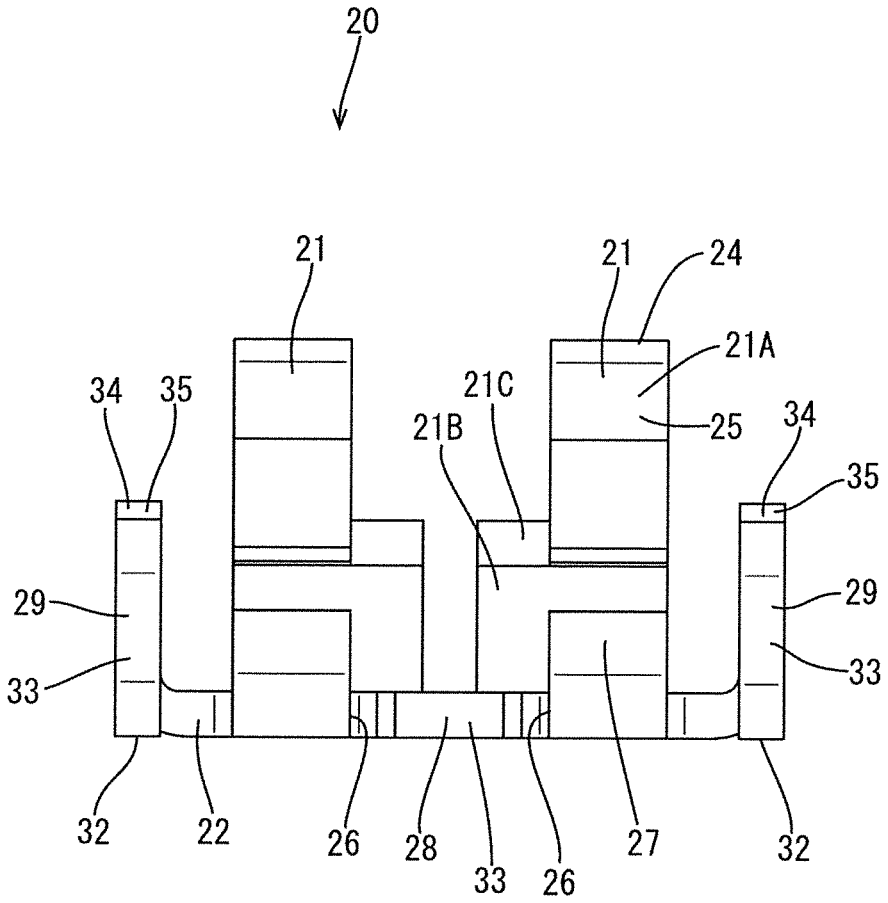
FIG. 5 is a front view of the shorting terminal.
Figure 6:
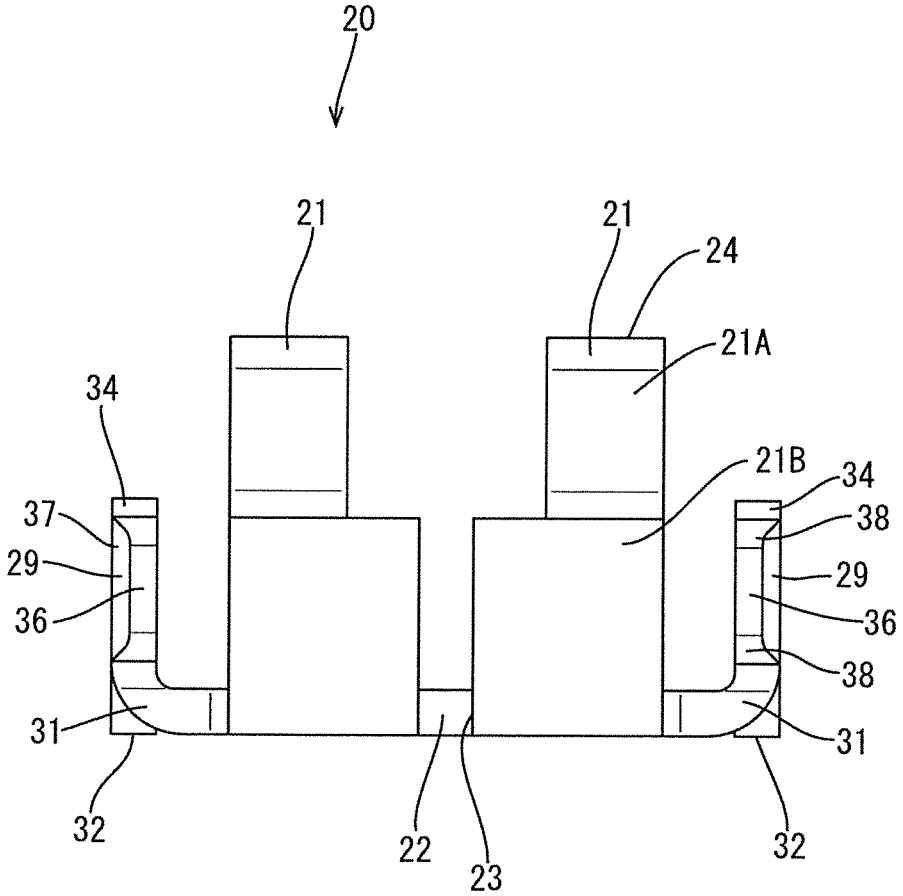
FIG. 6 is a rear view of the shorting terminal.

The shorting terminal 20 is formed by press-working an electrically conductive metal plate and includes two resilient contact pieces 21 that can resiliently contact the female terminal fittings 10 (see FIG. 4). The resilient contact pieces 21 are formed by folding parts at opposite sides of a rear slit 23 in a rear part of a base plate 22 forward at the rear end position of the shorting terminal 20 (see FIGS. 8 and 9). The resilient contact pieces 21 are cantilevered forward and are resiliently deformable in the vertical direction with a rear end part of the shorting terminal 20 (folded part) as a support.

A front part 21A of the resilient contact piece 21 is formed into a chevron shape and is arranged to project into the cavity 42 located thereabove in a state where the shorting terminal 20 is accommodated in the shorting terminal accommodating chamber 46. The top of this front part 21A defines a contact 24 to contact the female terminal fitting 10 and a part of the front part 21A before the contact 24 defines a guide 25 for guiding the short releasing portion 84 between the contact 24 and the female terminal fitting 10. The guide 25 extends obliquely down from the contact 24 and has an appropriate length to fully exhibit a function of guiding the short releasing portion 84.

The front part 21A of the resilient contact piece 21 has a smaller width than a rear part 21B. A width of an intermediate part 21C located between the front part 21A and the rear part 21B of the resilient contact piece 21 is increased gradually from the front part 21A toward the rear part 21B (see FIG. 8). The resilient contact piece 21 has an outer side edge opposite to a side where the resilient contact pieces 21 are facing each other. The outer side edge extends straight over the entire length without any step.

A front part of the base plate 22 is formed with two front slits 26 (see FIG. 8) and excessive deformation preventing portions 27 for preventing excessive deformation of the resilient contact pieces 21 are provided at opposite outer sides of the front slits 26. The excessive deformation preventing portions 27 are formed by bending the front ends of parts of the base plate 22 at the opposite outer sides of the front slits 26 upward. The excessive deformation preventing portions 27 are arranged right below the resilient contact pieces 21 and slightly before the contacts 24 of the resilient contact pieces 21 in a natural state (see FIG. 10).

Figure 8:
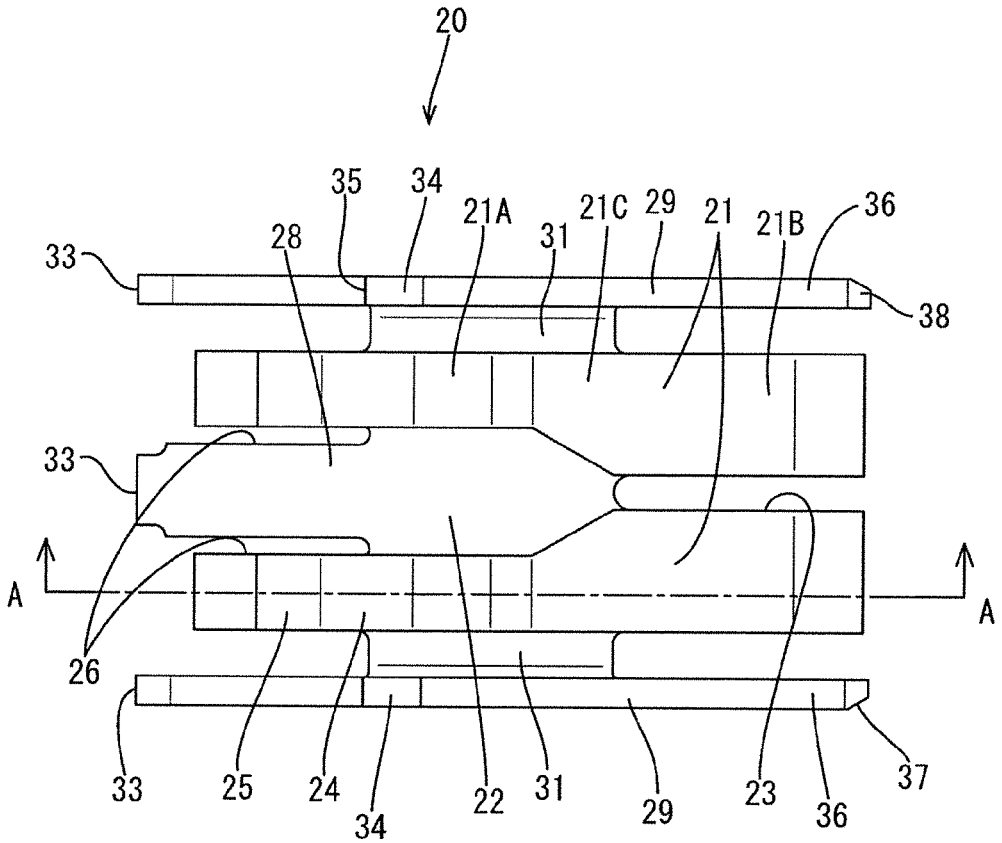
FIG. 8 is a plan view of the shorting terminal.
Figure 9:
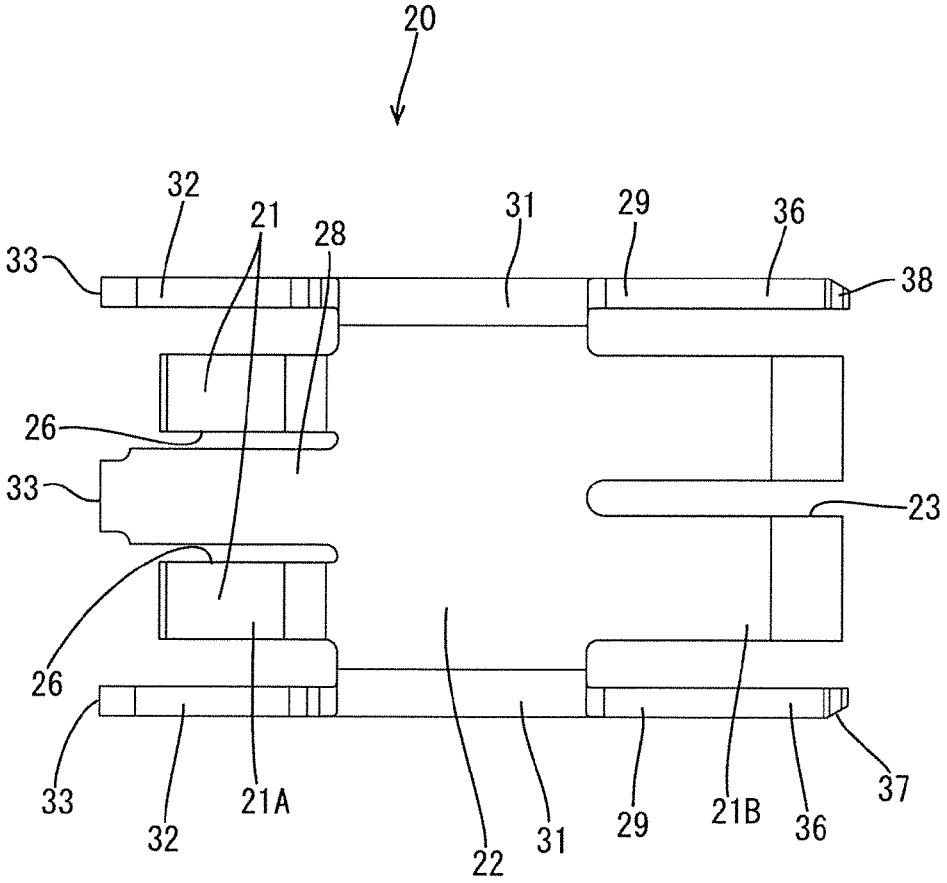
FIG. 9 is a bottom view of the shorting terminal.

An inner part of the base plate 22 between the front slits 26 defines a central projection 28 projecting more forward than opposite outer sides (see FIG. 8).

Two side plates 29 are provided at opposite outer sides of the resilient contact pieces 21. The side plates 29 stand up from opposite side edges of the base plate 22 and intermediate parts thereof in the front-back direction are connected to the base plate 22. Coupling parts of the side plates 29 and the base plate 22 are referred to herein as couplings 31.

Figure 10:
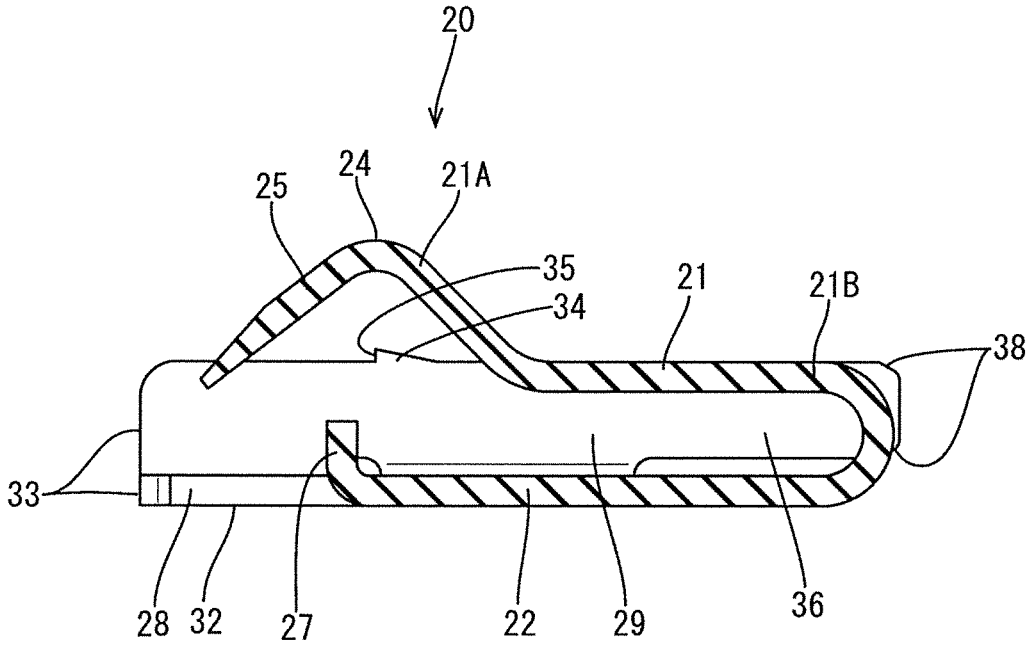
FIG. 10 is a cross-section along A-A of FIG. 8.

As shown in FIG. 10, the front part 21A of the resilient contact piece 21 projects farther up than the side plate 29 and the rear part 21B is arranged along the upper edge of the side plate 29 and does not project up from the side plate 29. Further, the tip of the resilient contact piece 21 is located behind the front end of the side plate 29.

Figure 14:
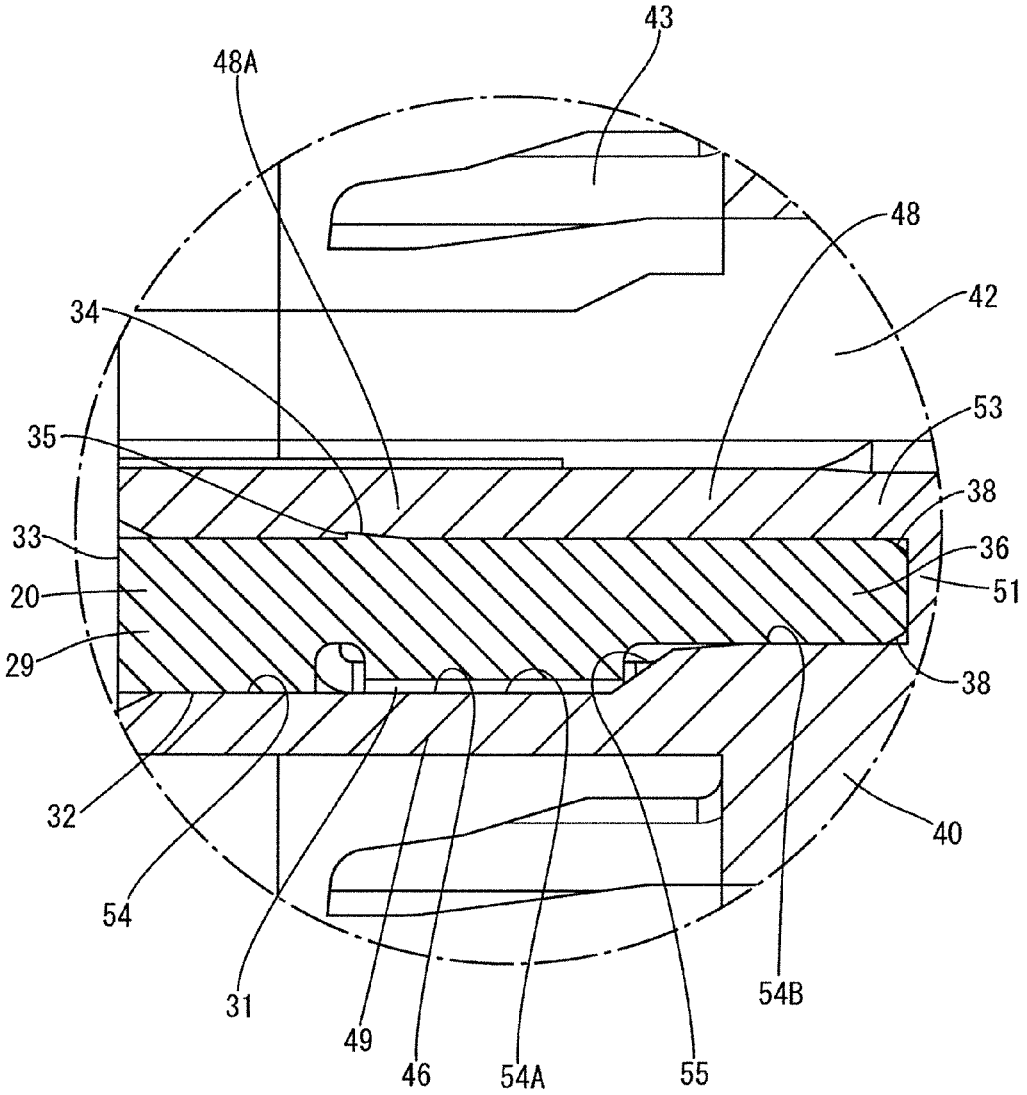
FIG. 14 is a partial enlarged view of FIG. 12 showing a state where a side plate portion of the shorting terminal is fit in a side plate fitting portion.

Supports 32 are provided on front end parts of the side plates 29 before the couplings 31 (see FIGS. 3, 4 and 14). The supports 32 are located slightly below other parts of the lower edges of the side plates 29 and are at the same height as the lower surface of the base plate 22 (see FIGS. 4 and 5). The supports come into contact with a bottom wall 49 of the shorting terminal accommodating chamber 46 to support the front end of the shorting terminal 20 when the shorting terminal 20 is accommodated into the shorting terminal accommodating chamber 46.

As shown in FIG. 8, the front ends of the side plates 29 are arranged at the same position as the front end of the central projection 28 on the base plate 22 in the front-back direction of the side plates 29 and that of the central projection 28 serve as press-contact portions 33 against which a jig is pressed when the shorting terminal 20 is pushed into the shorting terminal accommodating chamber 46. The press-contact portions 33 are surfaces perpendicular to a pushing direction of the shorting terminal 20.

Front press-fit portions 34 to be press-fitted to side edges 48A (see FIGS. 13 and 14) of the shorting terminal accommodating chamber 46 to be described later are provided at positions of the shorting terminal 20 juxtaposed with the contact portions 24 in a width direction (see FIGS. 7 and 8). One front press-fit portion 34 is provided on each of the pair of side plates 29 and both front press-fit portions 34 are located right lateral to the contact portion 24.

Figure 7:
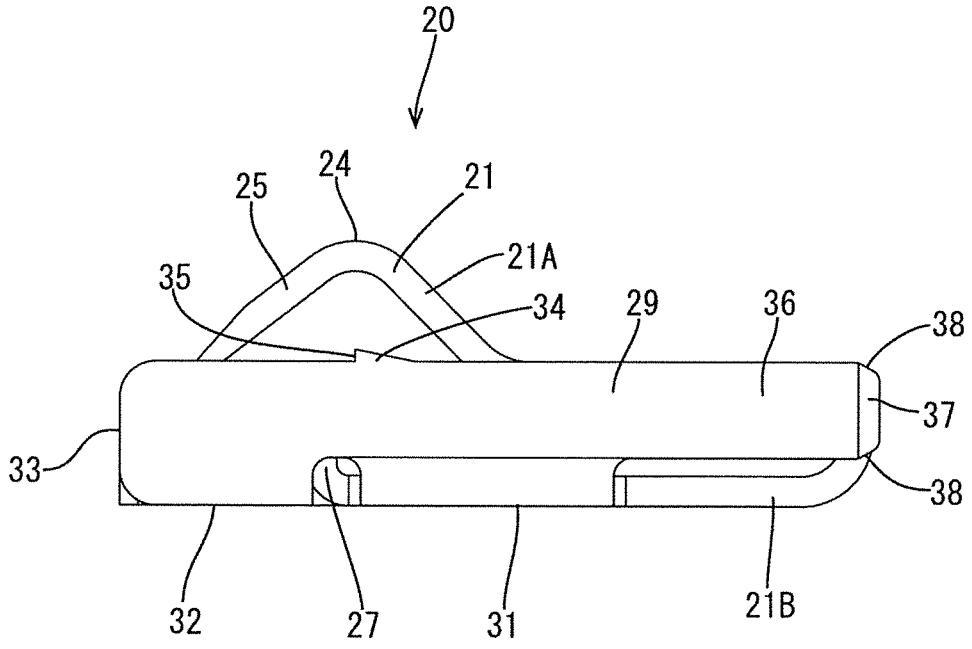
FIG. 7 is a side view of the shorting terminal.

As shown in FIG. 7, the front press-fit portion 34 is a projection projecting on the upper surface of the side plate 29. The front end of the front press-fit portion 34 is a vertically upright locking surface 35. When the shorting terminal 20 is accommodated into the shorting terminal accommodating chamber 46, the front press-fit portions 34 are locked to the female housing 40 to prevent the shorting terminal 20 from coming out forward. The upper surface of the front press-fit portion 34 is inclined slightly down toward the back from the upper end of the locking surface 35, so that the front press-fit portion 34 can be press-fit smoothly to the female housing 40.

A part of the side plate 29 behind the coupling 31 defines a rear press-fit portion 36 to be press-fit into a closed portion 53 (see FIGS. 1, 3 and 14) of the shorting terminal accommodating portion 46 to be described later. A vertical dimension of the rear press-fit portion 36 is substantially constant.

A first guiding portion 37 (see FIG. 7) for guiding the side plate 29 into a side plate fitting portion 54 (see FIG. 15) of the shorting terminal accommodating chamber 46 to be described later is provided on the outer edge of the rear end of the rear press-fit portion 36, and second guiding portions 38 (see FIG. 7) for guiding the side plate 29 into a press-fit portion 54B of the side plate fitting portion 54 are provided on the upper and lower edges of the rear end of the rear press-fit portion 36. The first and second guiding portions 37, 38 are tapered surfaces for reducing a width of the rear press-fit portion 36 toward the rear end.

Figure 11:
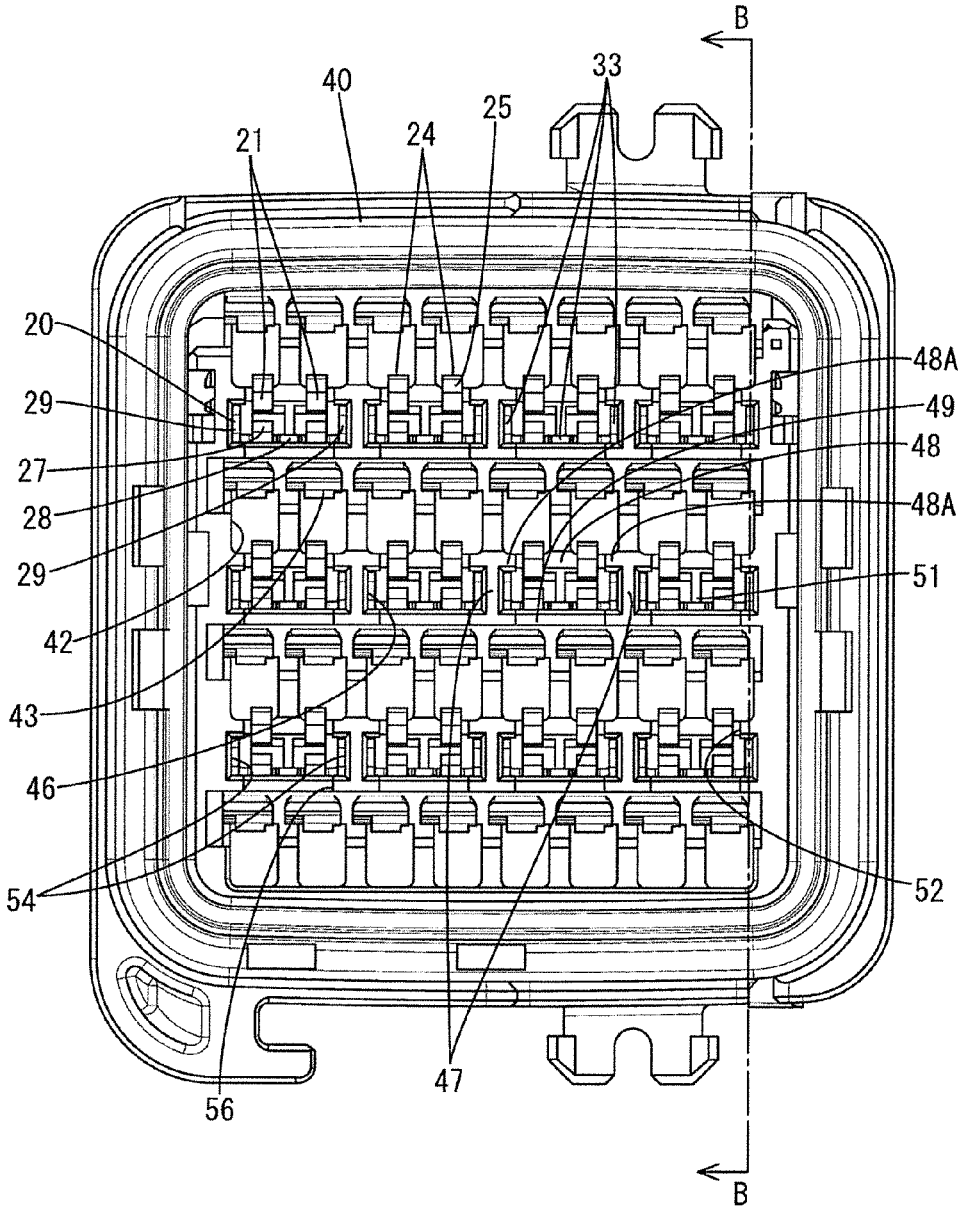
FIG. 11 is a front view of a female housing in which shorting terminals are accommodated.
Figure 12:
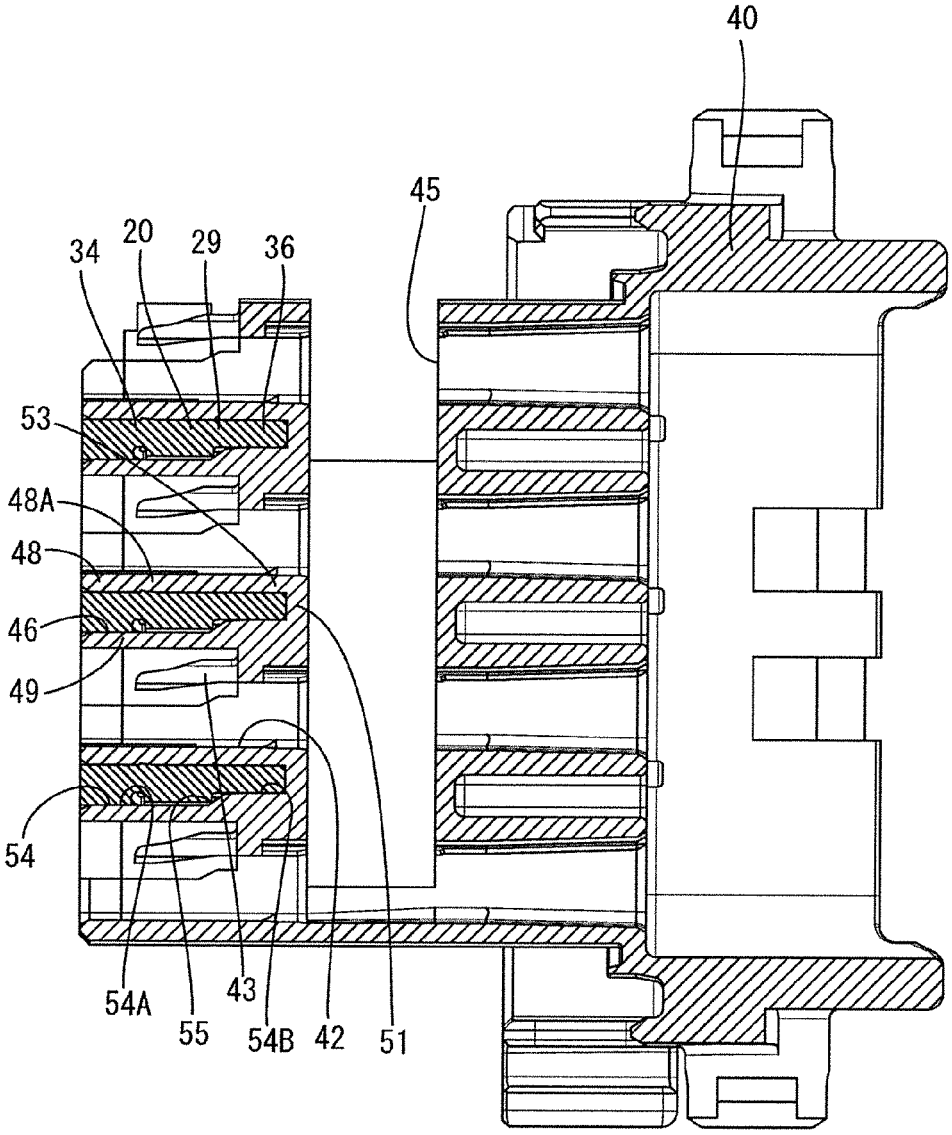
FIG. 12 is a section along B-B of FIG. 11, showing the female housing in the state where the shorting terminals are accommodated.
Figure 15:
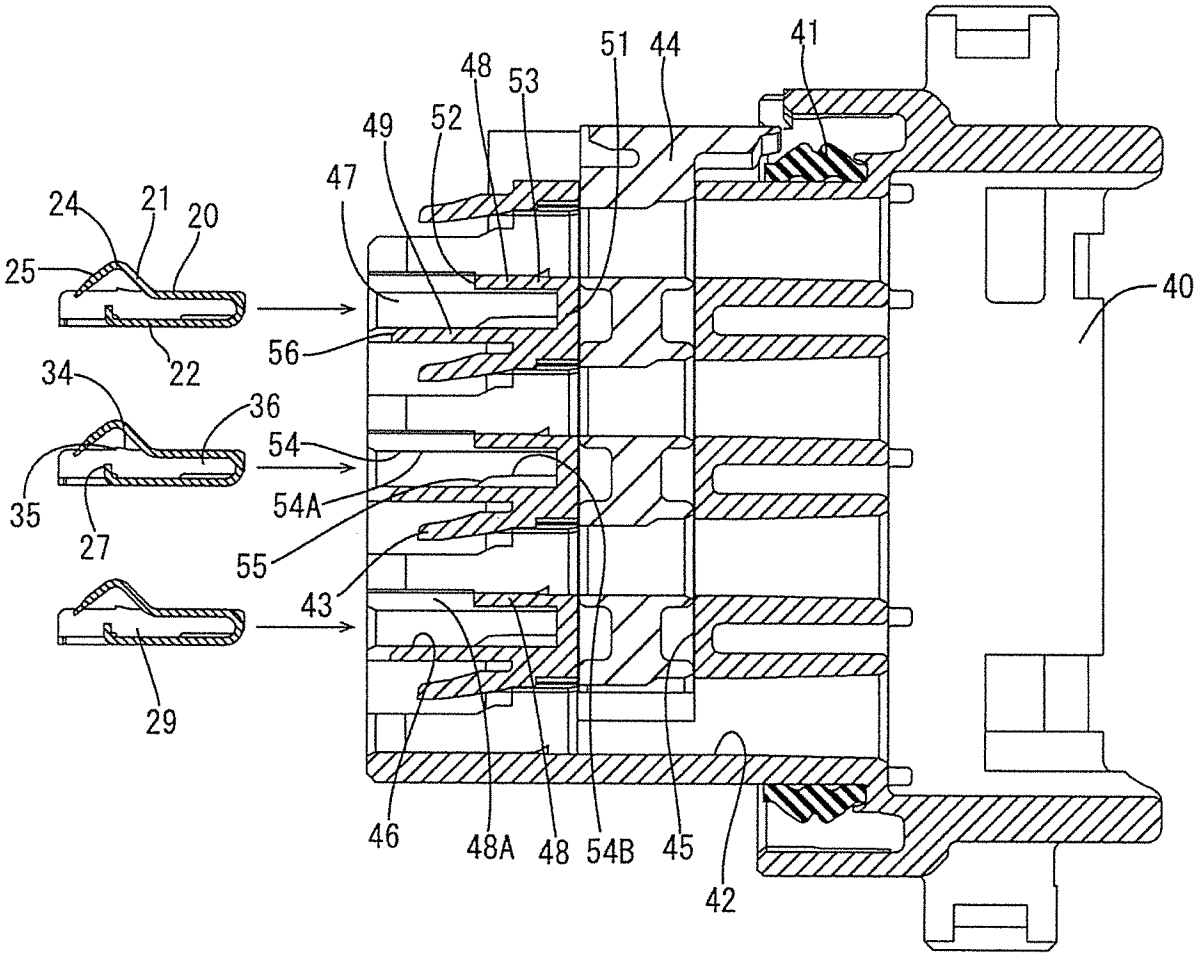
FIG. 15 is a section showing a state before the shorting terminals are accommodated in the female housing.

As shown in FIGS. 11 and 15, the shorting terminal accommodating chamber 46 is surrounded on four sides by two side walls 47, a ceiling wall 48 and the bottom wall 49 and is open forward. The shorting terminal 20 can be accommodated into the shorting terminal accommodating chamber 46 from the front. The shorting terminal accommodating chamber 46 has a width extending over two cavities 42 provided thereabove. Note that the shorting terminal accommodating chamber 46 is formed in a part of the female housing 40 before the retainer inserting portion 45.

An opening 52 penetrates a front part of the ceiling wall 48 of the shorting terminal accommodating chamber 46 and opens forward for allowing the contact portions 24 of the shorting terminal 20 to project into the cavity 42 (see FIG. 15). The opening 52 is substantially rectangular and has a width so that the contact portions 24 of the resilient contact pieces 21 can project up.

A rear wall 51 is provided in a rear end part of the shorting terminal accommodating chamber 46. Thus, the part of the shorting terminal accommodating chamber 46 rearward of the opening 52 is formed into the bag-like closed portion 53 defined by the two side walls 47, the ceiling wall 48, the bottom wall 49 and the rear wall 51. The rear wall 51 prevents the shorting terminal 20 accommodated in the shorting terminal accommodating chamber 46 from coming out backward.

Figure 13:
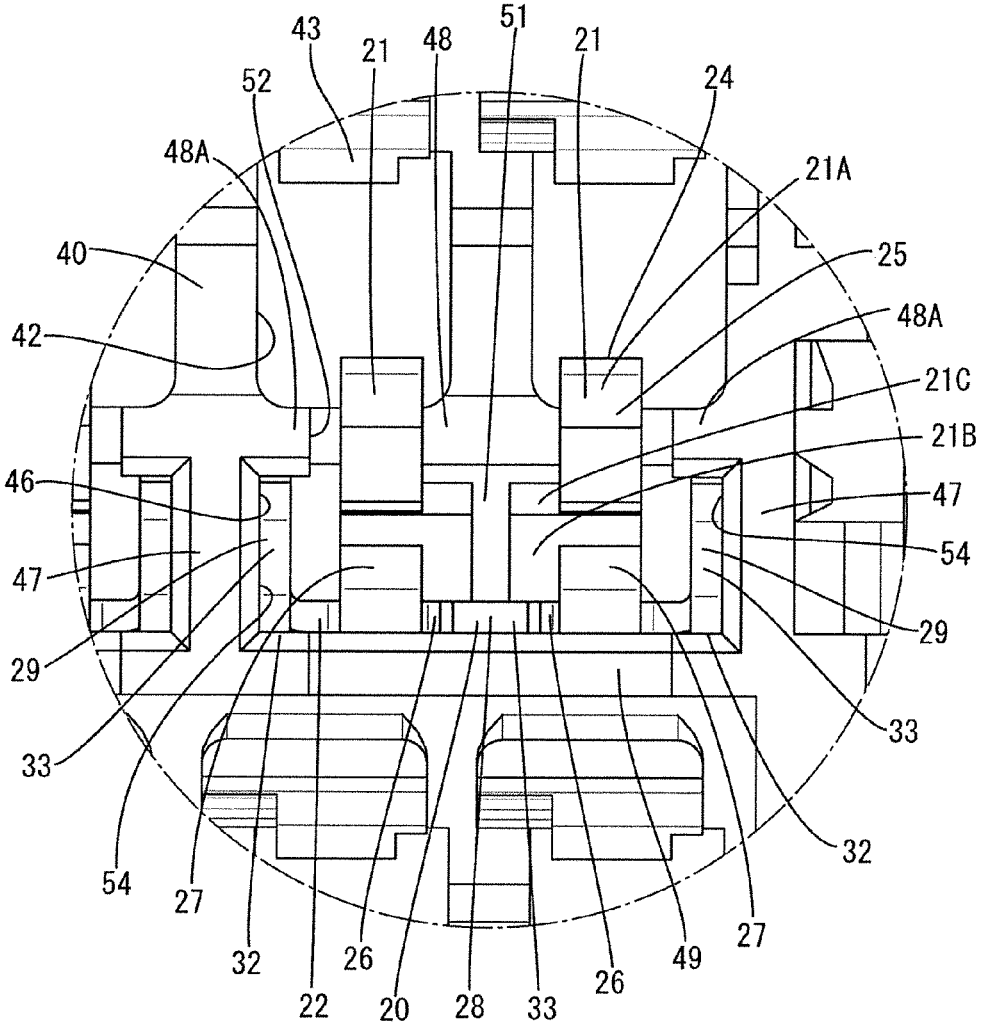
FIG. 13 is a partial enlarged view of FIG. 11 showing a state where the shorting terminal is housed in the female housing.

The side edges 48A are left at opposite sides of the opening 52 of the ceiling wall 48, and the shorting terminal accommodating chamber 46 is formed with the side plate fitting portions 54 into which the side plates 29 of the shorting terminals 20 are fit along the side walls 47 (see FIGS. 13 and 14). A substantially front half of the side plate fitting portion 54 is surrounded by the side wall 47, the bottom wall 49 and the side edge 48A of the ceiling wall 48 and defines an inserting portion 54A into which a substantially front half of the side plate 29 is tightly inserted. Further, a substantially rear half of the side plate fitting portion 54 is a part of the closed portion 53 surrounded by the side wall 47, the bottom wall 49, the ceiling wall 48 and the rear wall 51 and serves as the press-fit portion 54B into which the rear press-fit portion 36 of the side plate 29 is press-fit.

A step 55 is formed on the bottom surface of the side plate fitting portion 54 and the press-fit portion 54B is located slightly above the inserting portion 54A. This makes a vertical dimension of the side plate fitting portion 54 smaller at the press-fit portion 54B than at the inserting portion 54A. Note that the ceiling wall 48 has an entirely flat wall surface, unlike the bottom surface.

A forwardly open escaping portion 56 is provided on the bottom wall 49 of the shorting terminal accommodating chamber 46 for allowing the resiliently deformed resilient contact pieces 21 to escape by being pushed by the short releasing portion 84 (see FIGS. 1 and 15). The escaping portion 56 is a cut portion formed on a front end part of the bottom wall 49 and has a wide rectangular shape and open forward.

A front holder 70 is mounted on the front surface of the female housing 40 and is made of a synthetic resin. The front holder 70 includes a front wall 71 constituting the front wall of the female housing 40 when mounted on the female housing 40 and a peripheral wall 72 projecting back from the outer periphery of the front wall 71. Thus, the front holder 70 has a bottomed tubular shape that opens rearward. In a state where the front holder 70 is mounted on the female housing 40, the rear end of the peripheral wall 72 faces the front end of the seal ring 41 to prevent the seal ring 41 from coming off forward (see FIG. 3).

Terminal insertion openings 73 are provided at positions of the front wall 71 of the front holder 70 corresponding to the respective cavities 42 and enable insertion of the male terminal fittings 81 into the cavities 42 from the front. Further, short releasing holes 74 are provided at positions of the front wall 71 of the front holder 70 corresponding to the respective openings 52 and enable insertion of the short releasing portions 84 into the openings 52 from the front. Insulating portions 75 are provided on the front wall 71 of the front holder 70 below the escaping portions 56 for insulating the resilient contact pieces 21 and the female terminal fittings 10 that are arranged below the resilient contact pieces 21 from each other.

Figure 16:
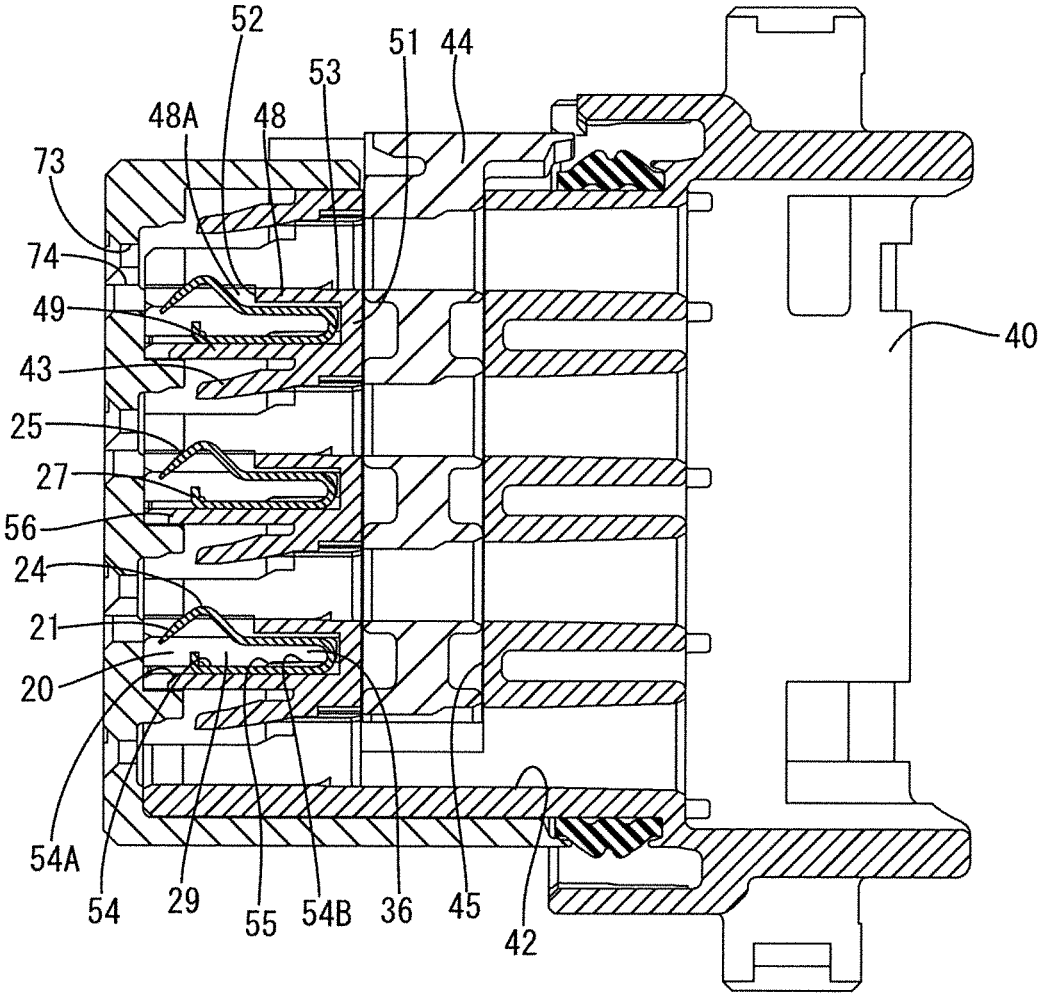
FIG. 16 is a section showing a state where the shorting terminals are accommodated in the female housing and a front holder is mounted.

An assembling procedure of the female connector F may initially insert the shorting terminal 20 into each shorting terminal accommodating chamber 46 (see FIGS. 15 and 16). The shorting terminal 20 is pushed into the shorting terminal accommodating chamber 46 by bringing unillustrated pressing pins into contact with the press-contact portions 33 of the shorting terminal 20 and pressing them. The rear part of the shorting terminal 20 then is inserted into the substantially front half of the shorting terminal accommodating chamber 46 almost with no resistance and, eventually, the front parts 21A of the resilient contact pieces 21 start entering the opening 52 without being resiliently deformed.

The contact portions 24 of the resilient contact pieces 21 start entering the opening 52 as the shorting terminal 20 is pushed farther back. Additionally, the rear press-fit portions 36 are guided to the press-fit portions 54B by the inclination of the steps 55 and start to be press-fit into the press-fit portions 54B. Further, the front press-fit portions 34 reach the front end of the shorting terminal accommodating chamber 46 and start to be press-fit to the side edge portions 48A of the ceiling wall 48. At this time, the rear surfaces of the front press-fit portions 34 are inclined. Thus, the front press-fit portions 34 start to be press-fit smoothly without being subjected to large resistance.

The entire shorting terminal 20 is accommodated into the shorting terminal accommodating chamber 46 as the shorting terminal 20 is pushed farther back. At this time, the shorting terminal 20 is in a posture so that the contact portions 24 project up through the opening 52 and contact the female terminal fittings 10. Further, the rear press-fit portions 46 are press-fit into the press-fit portions 54B and a rear end part of the shorting terminal 20 is fixed firmly in the female housing 40. Further, the front press-fit portions 34 are press-fit to the side edges 48A, and the shorting terminal 20 is fixed to the female housing 40 right lateral to the contact portions 24. Further, the locking surfaces 35 of the front press-fit portions 34 are locked to the female housing 40, thereby preventing the shorting terminal 20 from coming out forward. Note that the supporting portions 32 are in contact with the bottom wall 49.

The front holder 70 then is mounted on the female housing 40, and lower sides of the escaping portions 56 are closed by the insulating portions 75, as shown in FIG. 16. Further, the front ends of the cavities 42 and the shorting terminal accommodating chambers 46 are closed by the front wall 71 and the terminal insertion openings 73 and the short releasing holes 74 are arranged at predetermined positions.

Subsequently, the female terminal fittings 10 are inserted into each cavity 42 from behind with the retainer 44 held at the partial locking position. The female terminal fitting 10 inserted into each cavity 42 is locked primarily by the resin locking lance 43 when reaching a proper position. The female terminal fittings 10 that are to be shorted by the shorting terminals 20 are inserted to proper positions while resiliently deflecting and deforming the resilient contact pieces 21 projecting into the cavities 42 downward, and are locked by the resin locking lances 43 while being held in contact with the contact portions 24 of the resilient contact pieces 21, i.e. while being shorted. The retainer 44 then is moved to the full locking position so that each female terminal fitting 10 is locked secondarily by the retainer 44. In this way, the assembling of the female connector F is completed.

The female terminal fittings 10 and the shorting terminals 20 for shorting specific ones of the female terminal fittings 10 are accommodated respectively in the cavities 42 and the shorting terminal accommodating chambers 46 provided in the female housing 40. The resilient contact pieces 21 provided on the shorting terminals 20 are held in contact with the specific female terminal fittings 10 to short the specific female terminal fittings 10 in the state where the connector is not connected to the male connector M. Additionally, the short releasing portions 84 in the male connector M enter between the specific female terminal fittings 10 and the resilient contact pieces 21 to release the shorted state of the specific female terminal fittings 10 when the connector is connected to the male connector M. The contact portions 24 of the resilient contact pieces 21 to be held in contact with the female terminal fittings 10 are provided on a front side of the shorting terminal 20 in a connecting direction to the male connector M, and the shorting terminal accommodating chamber 46 is open forward in the connecting direction. Thus, the shorting terminal 20 can be accommodated into the shorting terminal accommodating chamber 46 from the front in the connecting direction, and the front press-fit portions 34 to be press-fit to the side edges 48A of the female housing 40 of the shorting terminal accommodating chamber 46 are provided at positions of the shorting terminal 20 juxtaposed with the contact portions 24 in the width direction.

The shorting terminal 20 is fixed to the female housing 40 at the positions juxtaposed with the contact portions 24 in the width direction, i.e. positions proximate to the contact portions 24. Accordingly, the looseness of the contact portions 24 of the shorting terminal 20 can be prevented, with the result that a contact pressure of the shorting terminal 20 with the female terminal fittings 10 can be stabilized. Further, in accommodating the shorting terminal 20 into the shorting terminal accommodating chamber 46, the front press-fit portions 34 start to be press-fit to the female housing 40 at a final stage of the accommodating operation. Thus, the accommodating operation can be performed more easily due to the side edges 48A located only on the rear side as compared with the case where side edges are present over the entire length and the front press-fit portions 34 are subjected to large resistance from the start to the end of the accommodating operation. Therefore, the shorting terminal 20 can be accommodated easily and connection reliability between the shorting terminal 20 and the female terminal fittings 10 can be enhanced.

Further, the rear end part of the shorting terminal accommodating chamber 46 in the connecting direction is formed into the bag-like closed portion 53 whose walls on the four sides and the rear side are connected, and the shorting terminal 20 includes the rear press-fit portions 36 to be press-fit into the closed portion 53. Here, the closed portion 53 whose walls on the four sides and the rear side are connected is highly rigid. Since the rear press-fit portions 36 are press-fit into such a part, the rear end part of the shorting terminal 20 is fixed firmly to the female housing 40. In this way, the looseness of the shorting terminal 20 can be prevented more reliably, with the result that a contact pressure of the shorting terminal 20 with the female terminal fittings 10 is stabilized. Further, in accommodating the shorting terminal 20 into the shorting terminal accommodating chamber 46, the rear press-fit portions 36 start to be press-fit into the female housing 40 at the final stage of the accommodating operation. Thus, the accommodating operation can be performed more easily as compared with the case where the rear press-fit portions 36 are subjected to large resistance from the start to the end of the accommodating operation. Therefore, the shorting terminal 20 easily can be accommodated and connection reliability between the shorting terminal 20 and the female terminal fittings 10 can be enhanced.

The opening 52 is provided in the ceiling wall 48 between the shorting terminal accommodating chamber 46 and the cavities 42 in which the female terminal fittings 10 are accommodated and opens forward in the connecting direction for allowing the contact portions 24 to project into the cavities 42. Thus, the shorting terminal 20 can be accommodated into the shorting terminal accommodating chamber 46 without the resilient contact pieces 21 being resiliently deflected, and no resistance is created by deflecting the resilient contact pieces 21 during the accommodating operation. Further, the shorting terminal 20 is accommodated into the shorting terminal accommodating chamber 46 without the contact portions 24 sliding in contact with the female housing 40. Thus, the abrasion of the contact portions 24 due to the sliding contact of the contact portions 24 with the female housing 40 is prevented. Therefore, connection reliability between the shorting terminal 20 and the female terminal fittings 10 is enhanced.

Further, the front press-fit portion 34 is a projection having the locking surface 35 upright on the front end in the connecting direction. This causes the front press-fit portion 34 to be hooked to the female housing 40 and prevents the shorting terminal 20 from coming out forward from the shorting terminal accommodating chamber 46.

The invention is not limited to the above described and illustrated embodiment. For example, the following embodiments are also included in the scope of the invention.

Although the front press-fit portions 36 are provided on the upper surfaces of the side plate portions 29 and bite into the side edge portions 48A of the ceiling wall 48 in the above embodiment, there is no limitation to this. For example, the front press-fit portions may be provided on the lower surfaces of the side plate portions and bite into the bottom wall.

Although the invention is applied to such a female connector F that the shorting terminal accommodating chambers 46 are respectively arranged between the cavities 42 in the four stages in the above embodiment, the number of the cavities and the number of the shorting terminal accommodating chambers are not limited to these and application to any connector is possible if the connector includes at least cavities and a shorting terminal accommodating chamber.

LIST OF REFERENCE SIGNS

F . . . female connector (connector)
M . . . male connector (mating connector)
10 . . . female terminal fitting (terminal fitting)
20 . . . shorting terminal
21 . . . resilient contact piece
24 . . . contact portion
34 . . . front press-fit portion
35 . . . locking surface (upright surface)

36 . . . rear press-fit portion
40 . . . female housing (housing)
42 . . . cavity
46 . . . shorting terminal accommodating chamber
48 . . . ceiling wall (partition wall)
48A . . . side edge portion (wall portion)
51 . . . rear wall
52 . . . opening
53 . . . closed portion
84 . . . short releasing portion

What is claimed is:

1. A connector, comprising:

a housing formed with cavities and at least one shorting terminal accommodating chamber;

terminal fittings accommodated respectively in the cavities; and a shorting terminal accommodated in the shorting terminal accommodating chamber, the shorting terminal having a base plate, first and second side walls bent up from opposite sides of the base plate, resilient contact pieces extending from a rear of the base plate and between the first and second side walls and configured to contact specific ones of the terminal fittings to short the specific terminal fittings when the connector is not connected to a mating connector, and a short releasing portion provided in the mating connector enters between the specific terminal fittings and the resilient contact pieces to release a shorted state of the specific terminal fittings when the connector is connected properly to the mating connector, wherein:

the resilient contact pieces have contact portions to be held in contact with the specific terminal fittings, the contact portions being provided on a front end of the shorting terminal in a connecting direction to the mating connector;

the shorting terminal accommodating chamber is open forward in the connecting direction and the shorting terminal is configured to be accommodated into the shorting terminal accommodating chamber from the front in the connecting direction, the shorting terminal accommodating chamber having opposed front press-fit areas at opposite lateral sides of the shorting terminal accommodating chamber and adjacent a front end of the respective shorting terminal accommodating chamber and opposed rear press-fit areas at opposite lateral sides of the shorting terminal accommodating chamber at positions rearward of the front press-fit areas, heights of the front press-fit areas being greater than heights of the rear press-fit areas; and each of the side walls defining a rear press-fit portion adjacent the rear end of the shorting terminal and having a height substantially equal to the height of the rear press-fit area of the shorting terminal accommodating chamber and further defining a front press-fit portions projecting up from an edge of the respective side wall opposite the base plate at positions of the shorting terminal juxtaposed with the contact portions in a width direction and substantially aligned with the contact portions along the connecting direction, areas of the side walls at the front press-fit portions exceeding the height of the front press-fit area of the respective shorting terminal accommodating chamber so that the shorting terminal is configured to be press-fit to a wall of the shorting terminal accommodating chamber only after the front and rear press-fit portions enter the respective front and rear press-fit areas.

2. The connector of claim 1, wherein:

a rear wall is provided on a rear end of the shorting terminal accommodating chamber in the connecting direction;

a rear end part of the shorting terminal accommodating chamber in the connecting direction is formed into a bag-like closed portion whose walls on four sides and a rear side are connected; and the rear press-fit portion is to be press-fit into the closed portion.

3. The connector of claim 1, wherein:

an opening for allowing the contact portions to project into the cavities is provided on a partition wall between the shorting terminal accommodating chamber and the cavities in which the specific terminal fittings are to be accommodated; and the opening is open forward in the connecting direction.

4. The connector of claim 1, wherein:

the front press-fit portion is a projection having an upright surface on a front end in the connecting direction.

5. A connector, comprising:

a housing with opposite front and rear ends spaced apart along a connecting direction, cavities extending through the housing from the front end to the rear end and at least one shorting terminal accommodating chamber having an open front end at the front end of the housing, the shorting terminal accommodating chamber having opposed front press-fit areas at opposite lateral sides of the shorting terminal accommodating chamber and adjacent the front end of the respective shorting terminal accommodating chamber and opposed rear press-fit areas at opposite lateral sides of the shorting terminal accommodating chamber at positions rearward of the front press-fit areas, a height of the front press-fit areas being greater than a height of the rear press-fit areas;

terminal fittings accommodated respectively in the cavities; and a shorting terminal in the shorting terminal accommodating chamber, the shorting terminal having opposite front and rear ends, a base plate and first and second side walls bent up from opposite sides of the base plate, forwardly cantilevered resilient contact pieces extending from an area of the base plate adjacent to the rear end of the shorting terminal and between the first and second side walls, the resilient contact pieces having contact portions configured to contact specific ones of the terminal fittings to short the specific terminal fittings when the connector is not connected to a mating connector, the contact portions being provided on a front end of the shorting terminal in the connecting direction, each of the side walls defining a rear press-fit portion adjacent the rear end of the shorting terminal and having a height substantially equal to the height of the rear press-fit area of the shorting terminal accommodating chamber and further defining a front press-fit portion projecting from edges of the first and second side walls respectively opposite the base plate and at opposite sides of the contact pieces in a width direction and substantially aligned with the contact portions along the connecting direction, areas of the side walls at the front press-fit portions exceeding the height of the front press-fit area of the respective shorting terminal accommodating chamber so that the shorting terminal is configured to be press-fit into the shorting terminal accommodating chamber only after the front and rear press-fit portions enter the respective front and rear press-fit areas.

6. The connector of claim 5, wherein the resilient contact pieces project rearward from the base plate and then are curved to project forward.

7. The connector of claim 6, wherein a distance from the base plate to the contact portions exceeds a distance from the base plate to the press fit portions.

8. The connector of claim 5, wherein the side plates have front ends forward of the resilient contact pieces and aligned with one another to define press-contact portions for pushing the shorting terminal into the shorting terminal accommodating chamber.

9. The connector of claim 5, further comprising a central projection projecting forward from the base plate and having a front end aligned with front ends side plates to define a further press-contact portion for pushing the shorting terminal into the shorting terminal accommodating chamber.

10. The connector of claim 5, wherein the respective front and rear press-fit areas have top surfaces that align with one another in the connecting direction and bottom surfaces that are offset from one another to define a step between the respective front and rear press-fit areas.

11. The connector of claim 5, wherein the shorting terminal accommodating chamber has a closed rear end.

* * * * *